United States Patent [19]

Aschberger et al.

[11] 4,344,545

[45] Aug. 17, 1982

[54] PILFERPROOF CLOSURE WITH MECHANICAL INTERLOCK

[75] Inventors: Anton A. Aschberger, Downers Grove; John Walter, Evergreen Park, both of Ill.

[73] Assignee: The Continental Group, Inc., Stamford, Conn.

[21] Appl. No.: 254,006

[22] Filed: Apr. 13, 1981

[51] Int. Cl.[3] ..... B65D 39/00

[52] U.S. Cl. ..... 220/307; 220/266; 220/270; 220/339; 222/153; 222/541; 215/235

[58] Field of Search ..... 220/266, 339, 270, 307, 220/214; 215/235, 250, 253; 222/153, 541

[56] References Cited

U.S. PATENT DOCUMENTS

| | | | |
|---|---|---|---|
| 3,080,088 | 3/1963 | Corrinet | 220/307 |
| 3,106,311 | 10/1963 | Fairchild | 220/307 |
| 3,127,064 | 3/1964 | Fairchild | 222/541 |
| 3,651,992 | 3/1972 | Hazard | 220/266 |
| 3,998,354 | 12/1976 | Song | 220/307 X |
| 3,999,678 | 12/1976 | Ignell et al. | 220/307 X |
| 4,006,839 | 2/1977 | Thiel et al. | 220/266 |

*Primary Examiner*—George T. Hall

*Attorney, Agent, or Firm*—John J. Kowalik

[57] ABSTRACT

A closure for a container having a lever-openable plug wherein the lever is attached to other parts of the closure by a frangible member which must be broken to permit actuation of the lever to open the plug, thus indicating to a subsequent observer that either the closure had been open or an attempt had been made to do so. The attachment of said frangible member comprising a post on the plug extending into a socket on the frangible member and interlocked therewith.

10 Claims, 5 Drawing Figures

FIG. 1
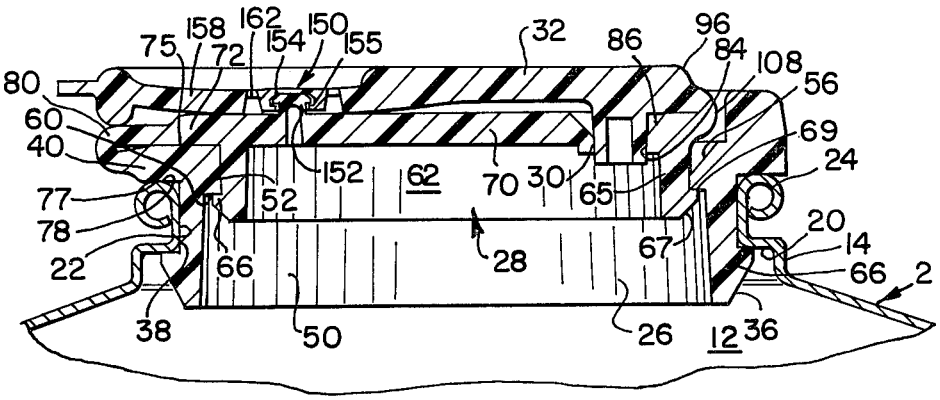
FIG. 2
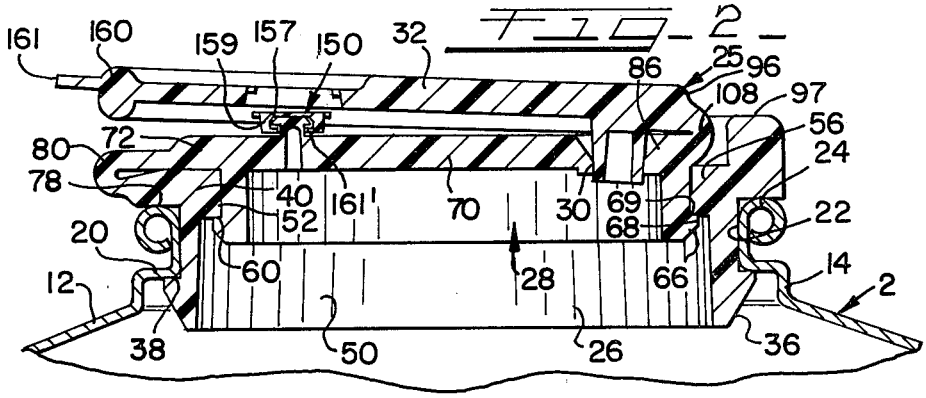
FIG. 3
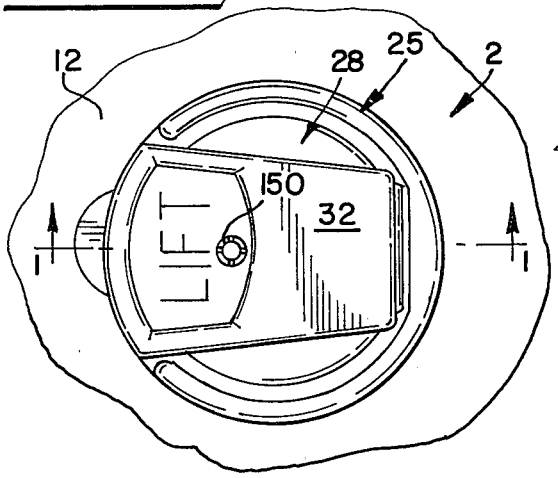
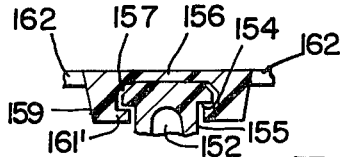
FIG. 5
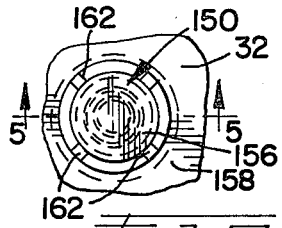
FIG. 4

PILFERPROOF CLOSURE WITH MECHANICAL INTERLOCK

BACKGROUND OF THE INVENTION

Containers of the type under consideration are for edible products and it behooves the manufacturer to secure its integrity against pilferage.

Various closures for containers of the foregoing type are available, such as shown in U.S. Pat. Nos. 3,251,499, 3,999,678 and 4,149,651.

DESCRIPTION OF THE PROBLEM

After considering available closures of the types above-mentioned, a number of problems were noted. Some of the most objectionable problems relating to such closures have been the lack of consistent positive closure under pressure and which are also relatively easy to open and simple to adapt to high speed manufacture and application and also easily detectable has having been opened. Structures of the general type under consideration have been heretofore made, but are more costly and the best references require a closure which must be torn open to reveal pilferage.

SOLUTION OF THE PROBLEM

The snap-close closure of the instant invention has been made not only to minimize the amount of material used but also providing a novel combined venting and opening-facilitating leverage structure with enhanced sealing integrity but also incorporating a means for indicating pilferage. The pilferage indicator is associated with the opening lever structure such that once the lever is lifted, it breaks apart a readily apparent non-repairable portion of the indicator and forms a hole through the center of the lever. Tampering is thus readily evident. The lever is formed to spring up when it is broken away from the indicator. Thus tampering is more readily apparent to the customer. Heat welding of the indicator to the parts from which it is to be broken away has been used but poses a problem in that if such mechanism malfunctions, the machine parts become coated with the melted plastic and downtime for cleanup of the machinery may be extensive.

SUMMARY OF THE INVENTION

This invention is directed to closures and, more particularly, to a pilfer indicator for such closures which is mechanically secured to its associated parts.

A main object of the invention is to provide a closure which may be easily manufactured in a simple single molding operation and may be machine-folded and the lever portion thereof tethered to the pilfer-indicator prior to application of the closure to the container.

A further object is to provide a novel closure having several parts tethered to each other and which are recloseable and in which the structure indicating tampering also holds the uppermost or lever portion of the closure loosely against the top of the closure plug, so that the tampering indicating structure will not break during normal handling.

Another object is to provide a plastic closure which is made as a single unit in a simple molding operation.

Another object is to provide a novel opening lever arrangement which first breaks the tamper-indicating indicia, then opens a vent and then pries the closure open with relatively small effort.

An object of the invention is to provide an interlock such as may be snapped together and wherein the parts are relatively loosely arranged to permit great tolerances and in which such tolerances permit the lever portion of the closure to be prelifted an amount sufficient to obtain a good purchase thereunder by the user. The construction also grants a wide latitude to handle movement such that the pilfer-indicia is not accidentally or prematurely broken.

These and other object inherent in and encompassed by the invention will become more apparent from the specification and the drawings wherein:

FIG. 1 is a cross-sectional view of the closure and a portion of the container taken substantially on line 1—1 of FIG. 3 showing the pilfer indicator unbroken;

FIG. 2 is a cross-sectional view the same as FIG. 1, showing the parts with the pilfer indicator broken;

FIG. 3 is a fragmentary top plan view;

FIG. 4 is an enlarged fragmentary top plan view; and

FIG. 5 is a section on line 5—5 of FIG. 4.

DESCRIPTION OF THE INVENTION

The invention is shown applied to a container 2 (fragmentarily shown) and made of aluminum but which may be made of any other material.

The upper open end portion of the container has a dome member 12 which is formed with a stepped neck. The neck 14 provides a shoulder 20 and an access opening 22. The neck 14 terminates in a curl 24 at its upper end.

A closure 25 made of plastic material is provided at the upper end of the container and comprises a tubular neck or sleeve portion 26, a closure plug portion 28 and a venting portion 30 to which is attached a finger grip lever or handle 32.

The neck portion 26 is a cylindrical member which at its lower end is tapered at 36 and is tightly wedged through the opening 22 (FIG. 3) and then expands radially outwardly and engages its shoulder 38 under the lower edge of shoulder 20 of the neck 14.

The neck portion 26 has an upper outwardly projecting annular flange 40 which engages the top edge of the curl 24 and provides a fluid-tight pressure seal with the shoulder 38.

The interior bore surface 50 of the neck portion 26 provides a pour and fill opening within which there is located a locking ring member or annular shoulder 52 with a bottom locking surface 60 which extends normal to the axis of the neck portion.

The plug 28 has a cylindrical side wall 62 which, adjacent to its lower edge, is provided with an annular locking ring or rib 66 which is of generally triangular cross-section having a lower downwardly tapered pilot surface 67 which is adapted to be guided with the inner face 56 of the neck or sleeve locking ring 52 when the plug or cap is pressed into the neck opening or bore 50 whereupon the apical edge 68 on ring 66 is deflected and the locking ring or shoulder 66 on the cap or plug slips under the shoulder 52 of the neck and a flat radially outwardly extending surface 69 at the upper side of the shoulder 66, normal to the axis of the neck or sleeve, locks under the face 60.

The plug portion or cap 28 has a top wall 70 integral with the upper end of the plug 28, the wall 70 extending beyond the perimeter of the plug and forms an annular rim portion 72, which on its underside, is pressed in position against the top surface 75 of the annular flange 40 integral with and extending radially outwardly from the upper end of the neck portion 26. The bottom side 77 of flange 40 presses against the crest 78 (FIG. 5) of the curl 24 of the metal neck 14.

A tether in the form of a narrow strap 80 connects a peripheral edge of flange 72 with a peripheral edge of portion 40 of the neck member 26.

The wall 70 is provided close to its marginal edge with a vent opening 84 in an area diametrically opposite to the tether 80 adjacent to the interior surface of the wall 65 of the plug.

A frusto-conical pilot cavity 86 is formed at the upper end of opening 84 for guiding the male venting closure pin or element 30 which in the closed position extends into the opening 84.

The upper end of the closure element or vent pin 30 depends from and is integrally connected with the lever member 32 intermediate its ends. The lever or handle 32 has a fulcrum end 96 which engages with the top edge the thickened portion of a C-shaped combination pouring lip and fulcrum rim 97 formed on the top side of the flange 40. The lever 32 is connected below the fulcrum end 96 to one end of a narrow strap 108 which is folded and which has its other end connected to the outer edge of flange 72 in an area diametrically opposite the strap 80.

A feature of the invention is the provision of a pilferproof structure 150 which comprises a post 152 which is formed integral with the top wall 70 and projects upwardly therefrom and has an upwardly tapered head and a lower annular shoulder 154. The head is forced through an opening 155 into a cavity 157 formed in an inverted cup shaped socket or receptable 150 molded on the underside of a disk 156 which is formed in the intermediate portion 158 of the handle or lever 32 in the plane thereof. The disk 156 is connected by a series of frangible straps or tethers 162 to the body edge section 164 of the handle portion 32. The handle or lever has a peripheral reinforcing rib 160 and a lift tab 61 facilitating entry of a finger thereunder. It will be noted that the cup shaped retainer has an annular side wall 158 at the lower edge of which is formed an inturned flange 161' which catches under shoulder 154. It will be seen that there is considerable space between the disk and the bottom flange 161' so that there is vertical play between the head of the rivet and as best seen in FIGS. 1 and 2, the tab 161 is capable of being lifted sufficiently to conveniently admit the finger or thumb of the user without excessive stress beneath the tab 161 such as will not break the straps 162.

To open the closure, the lever is lifted breaking the pilfer-indicator. The lever is swung over the fulcrum until the plug is withdrawn from the sleeve.

To reclose the closure, the plug 28 of the closure is pressed into the sleeve opening until the shoulder 52 snaps under the shoulder 66. Then the handle or lever is folded over the cap 28 and the vent plug or pin 30 is pressed into the vent opening 84. Since the pilfer-indicating straps 162 have been broken, it will be apparent to the observer that there is a strong probability that the closure has been previously opened. However, the pilferproof feature in no way interferes with the reclosing of the closure. The lever is so molded that when attached, as in FIGS. 1 and 2, it is stressed and biased upwardly being released by straps 162 being broken, it will assume an elevated position which brings attention to possible pilfering.

I claim:

1. A closure for a container having a wall member with an aperture, said closure comprising a sleeve member having a seal-tight fit within said aperture and having a bore providing a pour opening, a flexible plastic plug having a seal-tight fit within said opening, a lift lever connected to said plug, a combination pour lip and fulcrum projecting from one of said members for fulcruming engagement by said lever and lifting the plug out of the pour opening, a tearable anti-pilfer means on said lever, and limited-movement-permitting means connecting said anti-pilfer means to said plug, said anti-pilfer means being torn away from said lever upon lifting of said lift lever beyond the permitted limited movement.

2. A closure for a container, a tubular sleeve member providing a pour opening for said container, a resilient plug having, in the closed position, a seal-tight fit within said opening, a lift lever member, means tethering said lift lever member to said plug, said lift lever member having a fulcrum end and a lift end, combination fulcrum and lip guide means on said sleeve member extending axially thereof, said lift lever member being swingable over said combination means for prying said plug out of said opening, frangible tamper-indicating means being separable attendant to lifting of said lever member, and loosely telescoping means interconnecting said tamper-indicating means with said plug.

3. The invention according to claim 2 and said tamper-indicating means comprising a tear apart portion of said lever.

4. The invention according to claim 3 and said tear apart portion of the lever comprising a disk-like element formed as part of the lever intermediate its end.

5. A closure for a container comprising: a sleeve member having a bore providing a pour opening, a plug member having a seal fit with said sleeve member in closed position within said opening, a lever member overlying said plug member in the closed position of the closure, a tether connecting one end of the lever member to said plug member, a fulcrum on the sleeve member having an upper end positioned for engagement by said lever member attendant to said lever member being swung beyond a predetermined angle whereupon said lever member is caused to pivot on the fulcrum and pull the tether and thus lift said plug out of said opening, and a frangible pilfer-indicating means connected between the lever member and one of the other of said members and comprising a socket on one of said members and a post on the other member interlocked within said socket for accommodating prelift of the lever member without breaking of said pilfer-indicating means.

6. A closure for a container having a sleeve element insertable into an aperture in the container and having a pouring bore, a plug element insertable into the bore for closing the container, a lifting element operably associated with said plug element for opening the same, and frangible pilfer-indicating means including lost motion connecting means between at least one of said elements and said lifting element, said pilfer-indicating means adapted to break apart attendant to lifting of said lifting element beyond the extent of said lost motion.

7. The invention according to claim 6 and said lifting means comprising a tab laid over the top of said plug in the closed position of said closure.

8. The invention according to claim 7 and said pilfer-indicating means comprising a wafer-like member recessed within said tab and having a frangible connection therewith, and upon breaking away from the lever, leaving a visibly apparent hole therein.

9. The invention according to claim 8 and said closure being made of thermoplastic materials, said plug element having a top wall including an upstanding post of said connecting means, said post having an enlarged head, a cup-shaped socket on said wafer-like member receiving said head and having an inturned flange extended under said head.

10. The invention according to claim 9 and said wafer-life member being joined to said tab by at least one breakable strap.

* * * * *